US005813171A

United States Patent [19]

Piltingsrud

[11] Patent Number: 5,813,171

[45] Date of Patent: Sep. 29, 1998

[54] INTEGRATED POWER WINDOW OPERATOR

[75] Inventor: Stephen M. Piltingsrud, Owatonna, Minn.

[73] Assignee: Truth Hardware Corporation, Owatonna, Minn.

[21] Appl. No.: 751,584

[22] Filed: Nov. 18, 1996

[51] Int. Cl.[6] ..... E05F 15/00

[52] U.S. Cl. ..... 49/139; 49/341; 49/359

[58] Field of Search ..... 49/139, 140, 333, 49/340, 341, 339, 358, 359

[56] References Cited

U.S. PATENT DOCUMENTS

| | | | |
|---|---|---|---|
| Re. 34,287 | 6/1993 | Berner et al. . | |
| 2,138,521 | 11/1938 | Ellis | 49/358 X |
| 3,398,484 | 8/1968 | Katsumura et al. | 49/340 X |
| 4,045,914 | 9/1977 | Catlett | 49/334 |
| 4,497,135 | 2/1985 | Vetter . | |
| 4,658,545 | 4/1987 | Ingham et al. | 49/340 |
| 5,006,766 | 4/1991 | Yumas et al. | 49/139 X |
| 5,221,239 | 6/1993 | Catlett | 49/334 X |
| 5,313,737 | 5/1994 | Midas . | |
| 5,493,813 | 2/1996 | Vetter et al. . | |

FOREIGN PATENT DOCUMENTS

| | | | |
|---|---|---|---|
| 1510056 | 1/1968 | France | 49/358 |

*Primary Examiner*—Jerry Redman

*Attorney, Agent, or Firm*—Wood, Phillips, VanSanten, Clark & Mortimer

[57] ABSTRACT

An assembly for opening and closing a window sash from and against a window frame including a motor mounted to a window sash and having an output drive shaft, an operator arm having one portion pivotally connected to the sash and a second portion operably connected to the frame, and a drive train operably connecting the motor drive shaft to the output arm for controlling pivotal movement thereof in relation to the sash. A clutch mechanism permits the operator arm to be selectively disconnected from the drive train to allow the sash to be manually opened. A housing, disposable in a cavity defined in a generally rectangular box shape on a sash side, encloses the motor, drive train, and clutch mechanism. The housing has finger-jointed ends which are adhesively bonded to matching finger-joints formed on opposite sides of the sash cavity.

19 Claims, 2 Drawing Sheets

12'
14
59
54
56
52
86
55
54
58
57
50
26'
52
54
55
56
59
18
57
53
34
36'
10'
86
84

82
74
76
68
88
24'
78
72
70
28a'
20'
29a'
29b'
66
90
22'
80
47'
18
27a'
27'
27b'
28'
28b'
29'
29b'

34
36'
28a'
20'
29a'
66
76
70
78
72
74
24'
49'
48
26'
50
47
22'

INTEGRATED POWER WINDOW OPERATOR

BACKGROUND OF THE INVENTION

1. Technical Field

The present invention is directed toward pivoting windows, and more particularly toward a powered operator for a casement window sash.

2. Background Art

Motorized casement window operators have been implemented in the art for mechanically opening and closing a window sash relative to a window frame. For example, Vetter U.S. Pat. No. 4,497,135, Berner et al. U.S. Pat. No. 4,945,678 (Reissue U.S. Pat. No. 34,287), Midas U.S. Pat. No. 5,313,737, and Vetter et al. U.S. Pat. No. 5,493,813 all specifically disclose various motorized casement window hinges. In addition, it has been known to connect motor drives to the drive shaft of conventional manual window operators to retrofit such operators for motorized operation.

However, these prior art are often difficult to retrofit into existing construction without requiring that the window frame and/or surrounding wall be destroyed to fit components. In some installations (such as areas with old wallpaper), the destroyed wall/frame parts cannot be readily repaired to their original condition.

Further, with those prior art structures which can be more readily retrofit in existing installations, the resulting operator is generally obtrusively large. This tends to detract from the beauty of the wood or vinyl wrapped window and/or intrudes into the desired visual opening through the window.

Still further, with many prior art power window operators, there is an unacceptably high level of noise and high cost. Still further, retrofitting a power system to use the existing hardware results in very low operating speeds, since locating the retrofitted system at the optimum kinematic position is nearly impossible. Further, the prior art power window operators do not include the window itself in their design. This detracts from the window's aesthetic features, and makes it difficult to paint or stain the window, since the painter has to work around or cover up the implemented hardware for the power system.

The present invention is directed toward overcoming one or more of the problems discussed above.

SUMMARY OF THE INVENTION

In one aspect of the present invention, an assembly is provided for opening and closing a window sash from and against a window frame. The assembly includes a motor mounted to a window sash and having an output drive shaft, an operator arm having one portion pivotally connected to the sash and a second portion operably connected to the frame, means for operably connecting the motor drive shaft to the operator arm for controlling pivotal movement thereof in relation to the sash, and means for selectively controlling the motor.

In another aspect of the present invention, the assembly includes manually operable means for selectively releasing the operably connecting means to allow the sash to move independent of the motor drive shaft.

In preferred forms of this aspect of the present invention, the operably connecting means includes a gear reducing train operably connected to the motor drive shaft, driving means operably connected to the gear reducing train, and means for operably connecting the driving means to the operator arm for controlling pivotal movement thereof in relation to the sash.

In another preferred form of this aspect of the present invention, the assembly includes a housing disposable in a cavity defined in a generally rectangular box shape on a sash side, with the motor, the gear reducing train, the driving means, and the means for operably connecting the driving means to the operator arm being disposed in said housing.

In another preferred form of this aspect of the present invention, an integral mounting structure is provided for mounting a window sash control system to a window sash. The structure includes a window sash on one side having a substantially rectangular box shape with a selected thickness, a generally box-shaped cavity defined in the one sash side with finger-joints on the sash at opposite ends of the cavity, the cavity having a depth substantially equal to the selected thickness of the one sash side, and a generally box-shaped housing having two end walls connected by two side walls with at least one closing wall connected to the end walls and the side walls, the walls defining an enclosure adapted to receive a window sash control system. The end walls have matching finger-joints which engage the finger-joints on the opposite ends of the sash cavity, and the side walls each have substantially planar outer surfaces, with the outer surfaces substantially conforming to the outer surfaces of the one sash side.

In another preferred form of this aspect of the present invention, the housing walls are thermally non-conductive, and the housing finger-joints are adhesively bonded to the sash finger-joints.

One object of the present invention is to provide a power window operator which does not interfere with or detract from the beauty of the window.

Another object of the present invention is to provide a power window operator which will not intrude into the desired visual opening.

Still another object of the present invention is to provide a power window operator which incorporates the window itself in its design.

Yet another object of the present invention is to provide a power window operator with low noise levels and at a low cost.

It is another object of the present invention to provide a power window operator having a high operating speed.

It is still another object of the present invention to provide a power window operator which will not interfere with the maintenance of the window unit, such as painting, nor will it adversely affect the strength of the window unit over time.

It is yet another object of the present invention to provide an housing structure for suitably mounting a window sash control system to a window sash.

Still another object of the present invention is to provide a power window operator structure which may be easily retrofitted into existing construction.

Other objects and features of the invention will be readily apparent from the specification taken in view of the drawings.

DETAILED DESCRIPTION OF THE PREFERRED EMBODIMENTS

Figure 1:
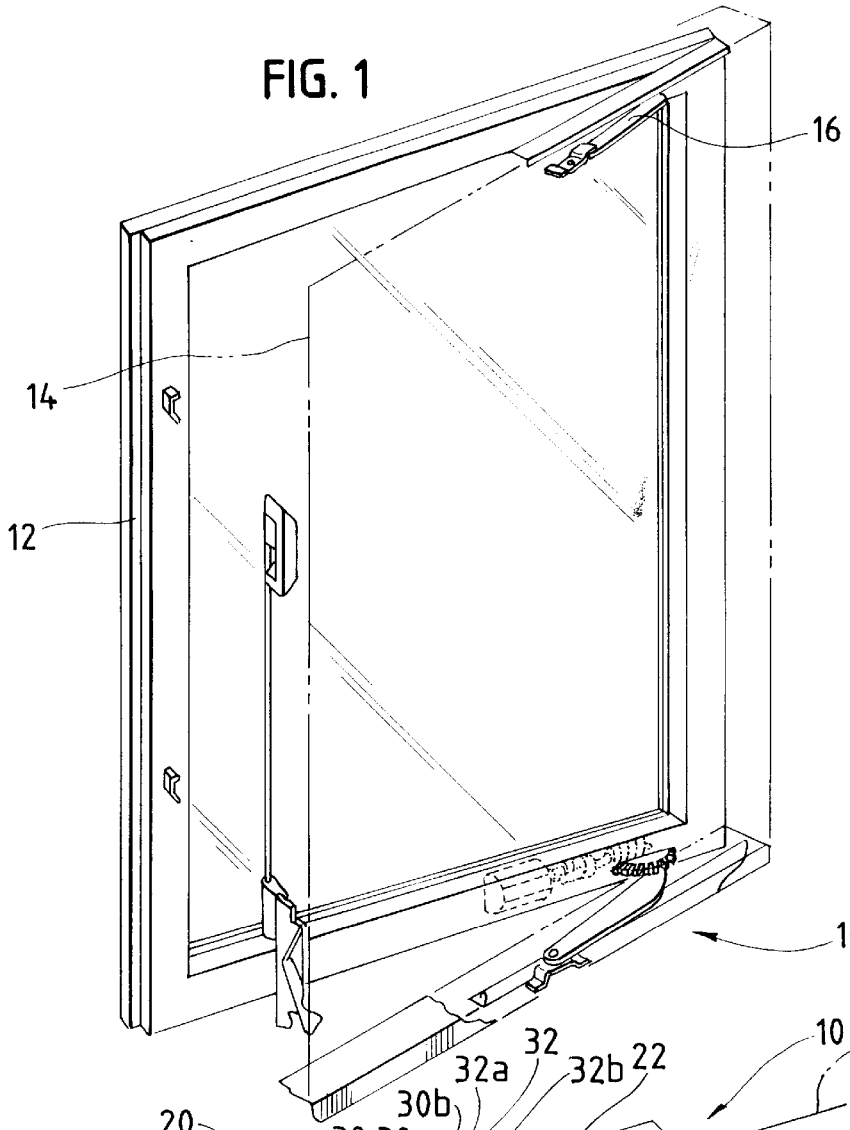
FIG. 1 is a perspective view of a window embodying a first embodiment of the power window operator of the present invention, with the components of the power window operator internal to the sash shown in phantom.

Referring to FIG. 1, a power window operator generally indicated by 10 is mounted to a side of a window sash 12. The window sash 12 is, in a preferred embodiment, part of a casement window which is pivotally mounted to a window frame or jamb, shown generally in phantom at 14, by the power window operator 10 and a suitable casement hinge 16 secured to the opposite side of the jamb 14 and sash 12.

It should be understood that though the description herein generally refers to casement windows, the present invention could also be used with a variety of different window types, including awning windows, french windows and skylights, as well as windows made of a variety of different materials, such as wood or vinyl wrap windows.

Power window operator 10, which will hereafter be described, is only one example of a type of power window operator which would benefit from incorporating the present invention. Though the particular power operator structure such as disclosed herein may be advantageously used with the present invention, once a full understanding of the present invention is obtained, it should be recognized that still other operator configurations for moving the sash relative to the jamb could also be advantageously used with the present invention.

Figure 2:
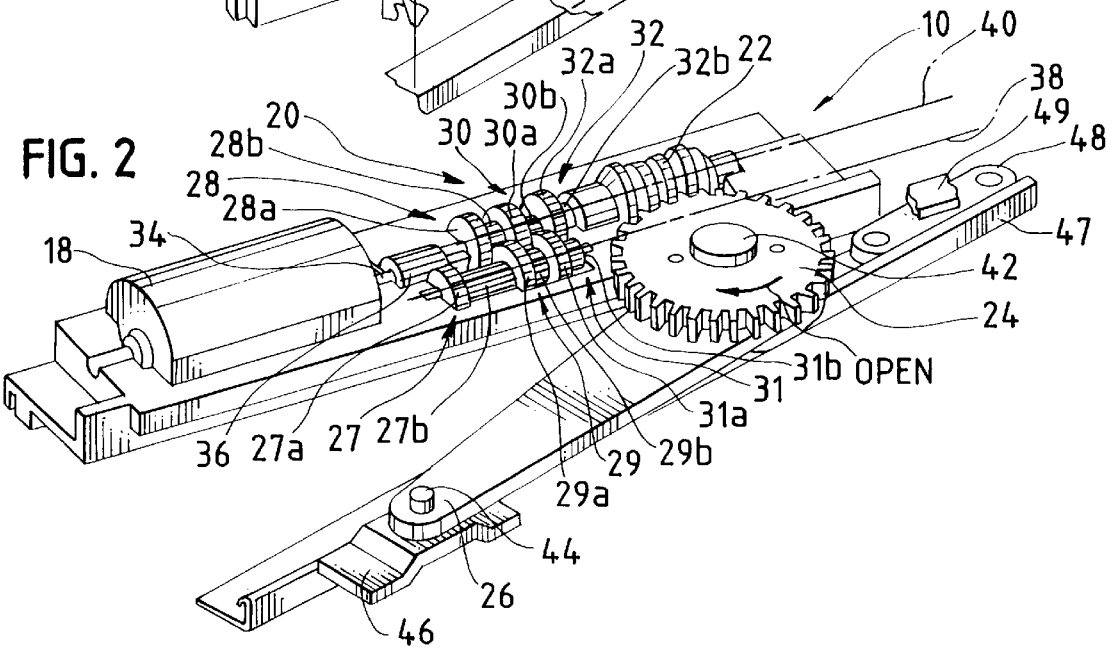
FIG. 2 is a perspective view of the power window operator of FIG. 1, with part of the housing removed.

Referring now to FIG. 2, the power window operator 10 is comprised of a motor 18, a gear reducing train shown generally at 20, a worm 22, a worm gear 24, and an operator arm 26.

Power and control lines (not shown) are suitably connected to the motor 18. Preferably, such lines extend from the motor 18 to the jamb 14 in any suitable manner. For example, the lines can be secured along the operator arm 26.

The gear reducing train 20 generally includes first through sixth gears 27–32. Each of the first through sixth gears 27–32 has a large diameter portion and small diameter portion. The large diameter portion of each gear is generally indicated with the suffix "a", and the small diameter portion of each gear is generally indicated with the suffix "b". The motor 18 drives a drive shaft 34, which has a drive shaft gear 36 operably secured to its end.

The drive shaft gear 36 engages the large diameter portion 27*a* of first gear 27. The small diameter portion 27*b* of first gear 27 engages the large diameter portion 28*a* of second gear 28. The small diameter portion 28*b* of second gear 28 engages the large diameter portion 29*a* of third gear 29. The small diameter portion 29*b* of third gear 29 engages the large diameter portion 30*a* of fourth gear 30. The small diameter portion 30*b* of fourth gear 30 engages the large diameter portion 31*a* of fifth gear 31. The small diameter portion 31*b* of fifth gear 31 engages the large diameter portion 32*a* of sixth gear 32. The small diameter portion 32*b* of sixth gear 32 is operably secured to worm 22. In the FIG. 2 embodiment, the first 27, second 29 and third 31 gears all rotate about a first axis 38, while the second 28, fourth 30 and sixth 32 gears, and the worm 22 all rotate about a second axis 40, which is spaced apart from and generally parallel to the first axis 38.

It should thus be appreciated that the disclosed gear reduction structure is a preferred structure which will permit use of a small, low-power, inexpensive motor 18 despite the large loads which are often encountered during opening and closing of the window sash 12, whether to overcome wind loads (particularly on large window sashes) or to create a weather strip seal when closing against the jamb 14 or to break the seal when initially opening.

The worm 22 engages the worm gear 24, rotating worm gear 24 about a generally vertical axis. A shaft 42 extends through the center of the worm gear 24 and is fixedly secured to one end of operator arm 26 so that the worm gear 24 and operator arm 26 pivot together. The other end of operator arm 26 is suitably secured to the jamb 14 to cooperate with the hinge 16 at the top of the sash 12 so that the sash 12 will open and close relative to the jamb 14 in response to pivoting of the operator arm 26.

For example, if a standard casement hinge typically has a sash arm secured along the sash 12, with one end pivotally secured to a shoe which is slidable along a track secured to the window jamb 14, and a support arm pivotally secured at one end to the jamb 14 and pivotally secured at the other end relative to the sash (typically pivotally connected directly to the sash arm). If the hinge 16 is such a standard casement hinge, the operator arm 26 would preferably be pivotally secured to the jamb 14 in a suitable manner, as by the pivot 44 and bracket 46 shown in FIG. 2. With such a configuration, a track 47 would preferably be secured to the jamb 14 (similar to the track of the hinge 16) and support a sliding shoe 48 thereon, with a sash arm 49 (shown broken away in FIG. 2) pivotally secured to the shoe 48 and suitably secured to the sash 12.

Operation of the FIG. 2 embodiment is as follows.

When the motor 18 is activated to open the window sash 12 from the jamb 14, the motor will cause drive shaft 34, and hence drive shaft gear 36 which is secured thereto, to rotate in a first direction. The gear reducing train 20 is responsive to the rotation of the drive shaft gear 36 and causes the worm 22 to rotate at a reduced rate with respect to drive shaft gear 36. Rotation of the worm 22 about the second axis 40 causes the worm gear 24 to rotate which in turn pivots the secured operator arm 26. Due to the geometry of the hinge 16 and the operator 10, pivoting of the operator arm 26 relative to the sash 12 will cause the sash 12 to move relative to the jamb 14, with the operator arm 26 pivoting relative to the jamb 14 about pivot 44, and the sash arm 49 in turn pivoting about the shoe 48 which slides along the track 47.

In the embodiment shown in FIG. 2, when the motor 18 is rotated in the direction opposite the first direction, the driving force will pivot the worm gear 24 and operator arm 26 in the opposite direction toward closing the sash 12 against the jamb 14.

It should be noted that the exact number and placement of gears 27–32 comprising the gear reducing train 20 is not imperative to the power window operator 10 of the present invention. Various numbers of gears, gear sizes and gear configurations can be implemented in the gear reducing train 20 without departing from the spirit and scope of the present invention. These variations will obviously depend many factors, including the size and shape of the window to be operably opened and closed, as well as the motor operation and the desired speed of moving the sash 12.

Figures 3, 4, 5:
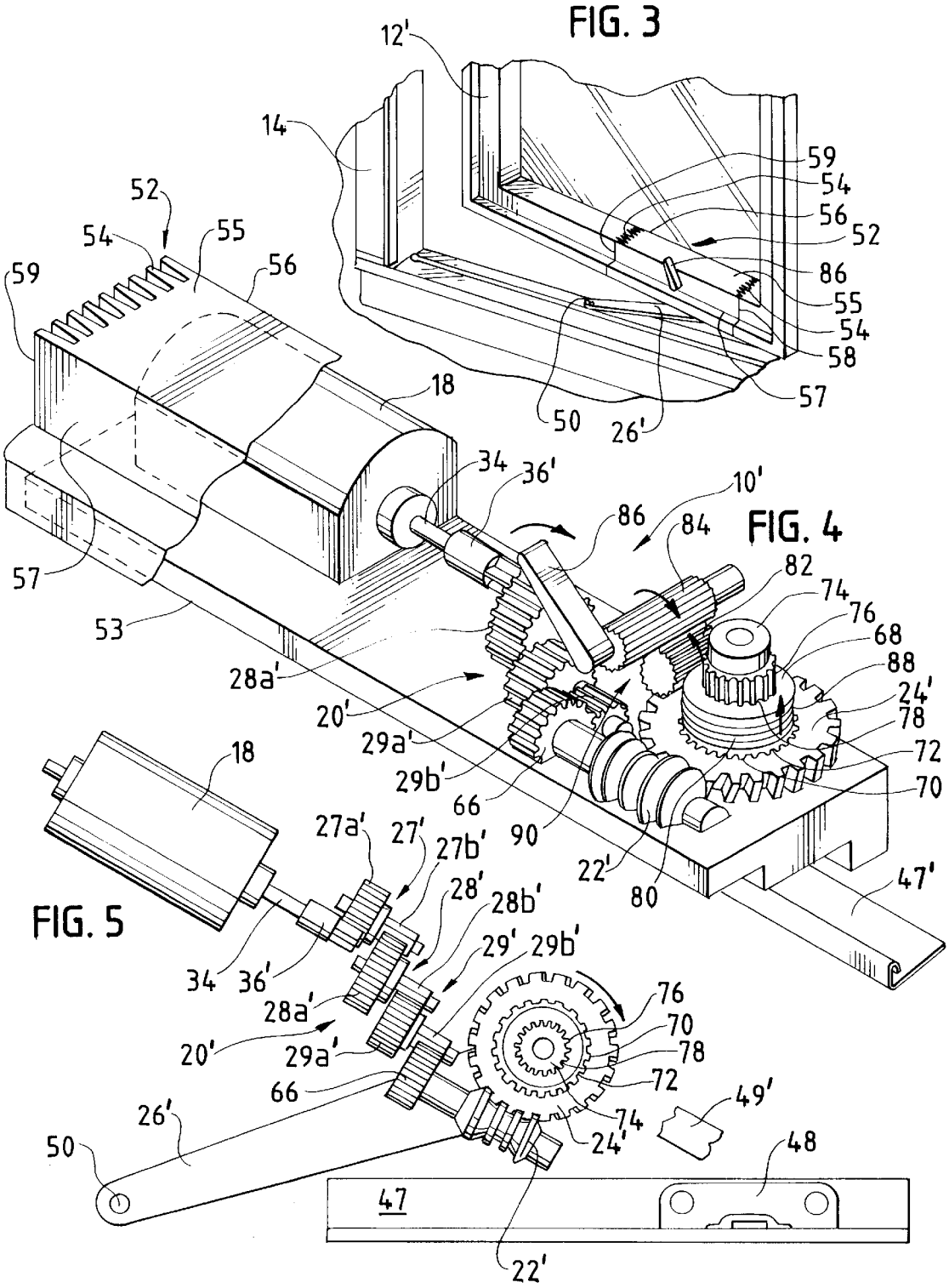
FIG. 3 is a partial perspective view of a window embodying a second embodiment of the power window operator of the present invention.
FIG. 4 is a perspective view of the power window operator of FIG. 3, with part of the housing removed.
FIG. 5 is a plan view of the power window operator as viewed from above FIG. 4.

A second preferred embodiment of the present invention is shown in FIGS. 3–5. For ease of reference, components similar to components previously described in the embodiment of FIGS. 1–2 are designated with similar reference numerals, though with a "prime" added.

FIGS. 3–5 show an a different power window operator 10' embodying the present invention. The operator 10' is ideally suited for use with a standard casement hinge such as previously described, as the worm gear 24' may be centrally located relative to the thickness of the sash 12' as best shown in FIG. 5, and therefore the sash arm 49' (see FIG. 5) may be readily aligned with the pivotal connection of the operator arm 26' to the sash 12', as is standard with casement hinges. As such, the operator 10' may be readily used in combination with a standard hinge on the top of the sash 12'.

As with the FIGS. 1–2 embodiment, power and control lines (not shown) are suitably connected to the motor 18. Preferably, such lines extend from the motor 18 to the jamb 14 in any suitable manner. For example, the lines can be secured along the operator arm 26'.

Referring to FIG. 3, the internal components of the window operator 10' are mounted inside a housing 52. Housing 52 includes sidewalls 56, 57, end walls 58, 59, and a closure wall 55 connecting the end walls 58, 59 and the sidewalls 56, 57. Housing 52 further includes a second closure wall 53 generally conforming to the shape of the bottom surface of the sash 12'. Second closure wall 53 connects the end walls 58,59 and the sidewalls 56,57 opposite closure wall 55. The housing 52 is disposable in a generally box-shaped cavity defined in one side of the sash 12'.

In a preferred embodiment, the housing 52 has finger-joints 54 (best seen in FIG. 4) on end walls 58, 59 which engage matching finger-joints on opposite sides of the sash cavity, and may be suitably secured to the sash cavity by, for example, an appropriate glue or adhesive (depending on the materials of the sash 12' and the housing 52).

It should be understood that though the above described housing is a preferred embodiment, in some installations the sash 12' may be big enough, or the below described components of the operator 10' small enough, so that the housing may be enclosed in a cavity with some of the walls being defined by parts of the sash 12'. Any such structure would be suitable so long as, in the preferred form, the outer surface would integrally conform with the basic outer surface of the sash surrounding the cavity.

In a preferred embodiment, the housing 52 is made of a thermally non-conductive material. Further, while the housing 52 herein is generally described for use with a power window operator 10', it should be recognized that the housing 52 could be implemented as an integral mounting structure for mounting any of a variety of window operating systems, including but not limited to, a power window lock.

The housing 52 is partially removed in FIG. 4 to show the internal components of the power window operator 10'. The power window operator 10' generally includes a motor 18 having a drive shaft 34 attached to a drive shaft gear 36', a gear reducing train shown generally at 20', a worm 22', a worm gear 24', and an operator arm 26' (shown in FIGS. 3 and 5). The gear reducing train 20' generally includes first through third gears 27'–29'. As best shown in FIG. 5, each of the first through third gears 27'–29' has a large diameter portion and a small diameter portion. The large diameter portion of each gear is generally indicated with the suffix "a", and the small diameter portion of each gear is generally indicated with the suffix "b".

The drive shaft gear 36' engages the large diameter portion 27*a'* of first gear 27'. The small diameter portion 27*b'* of first gear 27' engages the large diameter portion 28*a'* of second gear 28'. The small diameter portion 28*b'* of second gear 28' engages the large diameter portion 29*a'* of third gear 29'. The small diameter portion 29*b'* of third gear 29' is operably connected to worm 22' through a gear 66 having a diameter generally larger than the diameter of the worm 22' and located at a distal end of worm 22'. Gear 66 may be formed integral with worm 22' or fixedly secured to the distal end thereof. Gear 66 engages the small diameter portion 29*b'* of third gear 29' and rotates the worm 22' at the same rotational speed as gear 66. The worm 22' engages worm gear 24', rotating worm gear 24' about an axis generally perpendicular to the axis of the motor 18.

Again, the exact number and placement of gears 27'–29' comprising the gear reducing train 20' is not imperative to the power window operator 10' of the present invention. Various numbers of gears, gear sizes and configurations can be implemented in the gear reducing train 20' without departing from the spirit and scope of the present invention.

A cylindrical collar 68 extends through the center of worm gear 24'. The cylindrical collar 68 includes a bottom portion having outwardly projecting clutch teeth 70 which engage a cooperating set of inwardly projecting teeth 72 in a central opening in the worm gear 24' when the collar 68 and worm gear 24' are axially aligned.

The collar 68 also has an upper portion 88 having a set of axially spaced teeth 80 basically forming a rack. Although it will become apparent hereafter that the teeth 80 actually need to be on only one side of the collar 68, in the preferred embodiment the teeth 80 extend around the collar upper portion 88 to ease in assembly (as this allows the collar 68 to be assembled in any angular position).

A spline shaft 74 extends through both the cylindrical collar 68 and the worm gear 24' and is suitably mounted to the housing 52 and/or sash 12' for pivoting about the same vertical axis as the worm gear 24'. The spline shaft 74 is also suitable fixed to a distal end of the operator arm 26' so that the shaft 74 and arm 26' pivot together. The spline shaft 74 includes outwardly extending clutch teeth 76 extending along its length, which teeth 76 engage a mating set of inwardly extending teeth 78 on an inner surface of cylindrical collar 68 to secure the collar 68 and shaft 74 for pivoting together.

Operation of the embodiment shown in FIGS. 3–5 is similar to the operation of the embodiment in FIGS. 1–2.

Specifically, when the motor 18 is activated to open the sash 12' from the jamb 14, the motor 18 turns the drive shaft 34 and drive shaft gear 36' in a first direction. The gear reducing train 20' is responsive to the rotation of the drive shaft gear 36' and causes the worm 22' to rotate at a reduced gear ratio with respect to the drive shaft gear 36'. In one preferred embodiment, for example, the gear reducing train 20' achieves a reduction ratio of approximately 750:1 (with such a reduction rate permitting use of a small, low-power, inexpensive motor 18 despite the large loads which are often encountered during opening and closing of the window sash 12' as previously described).

Rotation of the worm 22' causes the worm gear 24' to pivot, which in turn pivots the cylindrical collar 68, which in turn pivots the spline shaft 74, which in turn pivots the operator arm 26' to open or close the sash 12' from or against the jamb 14 depending on the direction of pivoting of the spline shaft 74. That is, when the worm gear 24' pivots in a clockwise direction as viewed in FIG. 5, the sash 12' is closed toward the jamb 14, while counter-clockwise pivoting of the worm gear 24' opens the sash 12' away from the jamb 14.

FIG. 4 also shows a clutch mechanism indicated generally at 90 which cooperates with the previously described cylindrical collar 68 to permit the operator arm 26' to be disengaged from the gear reducing train 20' to free the sash 12' for manual opening and/or closing such as might be desirable, for example, in the event of a power outage. That is, since the worm 22' effectively prevents backdrive to prevent the sash 12' from being moved except through pivoting of the drive train and worm 22', the clutch mechanism 90 disengages the operator 10' from the worm 22' to permit movement of the sash 12' even though the worm 22' is not rotated The clutch mechanism 90 includes a control gear 82 rotatably mounted in the housing 52 and engaging the axially spaced teeth 80 of the cylindrical collar 68 An actuator gear 84 is also mounted in the housing so as to engage the control gear 82, with a handle 86 operably secured to the actuator gear 84 and projecting from the housing 52 (see FIG. 3) to permit manual pivoting of the handle 86.

As generally viewed in FIG. 4, clockwise pivoting of the handle 86 causes the actuator gear 84 to also rotate in a clockwise direction. This causes the control gear 82 to rotate in a counter-clockwise direction and, though its engagement with the collar axially spaced teeth 80, slides the cylindrical collar 68 upwardly on the spline shaft 74 sufficiently to disengage the clutch teeth 70 on the bottom portion of cylindrical collar 68 from the clutch teeth 72 on the inner surface of worm gear 24'. Accordingly, the spline shaft 74 and connected operator arm 26' may pivot independently of the worm gear 24' to permit manual moving of the sash independent of the motor 18, drive train, worm 22' and worm gear 24'.

It should thus be apparent that operators made according to the present invention may be readily integrated into the design of the window without detracting from the beauty of the window, and may be used even in retrofit installations without intruding into the desired visual opening of the window. Retrofitting, in fact, may be easily accomplished by simply adding a new sash incorporating the invention of the present invention, with only minimal modifications required of the existing construction to accommodate power and control cables. In this regard, the integrated design of the operator also will not interfere with the maintenance of the window unit, such as painting, nor will it adversely affect the strength of the window unit over time.

It should also be apparent that operators made according to the present invention may be made at relatively low cost despite the small space within which the drive components must be fit, since the operator allow for the use of low-power and therefore inexpensive motors while still maintaining the desired driving power and speed.

It should further be apparent that operators made according to the present invention will operate at low noise levels within the building. Not only is the motor completely enclosed in a housing to deaden sounds, but the motor is also located in the sash at a point which maximally spaced from the building interior. Moreover, through most of the sash's range of motion, the motor is actually disposed outside the building so that much of whatever noise does escape the housing will disperse outside the building.

Still other aspects, objects and advantages of the present invention can be obtained from a study of the specification, the drawings and the appended claims.

I claim:

1. An assembly for opening and closing a window sash from and against a window frame, the assembly comprising:

a motor mountable to the window sash, said motor having an output drive shaft;

an output arm having one portion pivotally connectable to the window sash and a second portion operably connectable to the window frame;

means for operably connecting said motor drive shaft to said output arm for controlling pivotal movement of said output arm in relation to the sash, said connecting means including a first transmission element drivably connected to the support arm and a second transmission element drivably connected to the output drive shaft; and manually operable means for selectively moving one of said first and second transmission elements relative to the other between a first position wherein the first and second elements are fixed together against relative movement by a non-slip connection to drivably connect said drive shaft to said output arm, and a second position wherein the first and second elements are secured together for selected movement relative to each other to drivably disconnect said drive shaft from said output arm.

2. An assembly for opening and closing a window sash from and against a window frame, the assembly comprising:

a motor mountable to the window sash, said motor having an output drive shaft;

an output arm having one portion pivotally connectable to the window sash and a second portion operably connectable to the window frame; and means for operably connecting said motor drive shaft to said output arm for controlling pivotal movement of said output arm in relation to said sash including a gear reducing train having first, second and third gears rotatable about a first axis, and fourth, fifth and sixth gears rotatable about a second axis parallel to said first axis, said first through sixth gears each having large and small diameter portions, wherein the large diameter portion of the first gear is operably connected to the motor drive shaft, the small diameter portion of the first gear engages the large diameter portion of the fourth gear, the small diameter portion of the fourth gear engages the large diameter portion of the second gear, the small diameter portion of the second gear engages the large diameter portion of the fifth gear, the small diameter portion of the fifth gear engages the large diameter portion of the third gear, the small diameter portion of the third gear engages the large diameter portion of the sixth gear, and the small diameter portion of the sixth gear is operably connected to the output arm.

3. An assembly for opening and closing a window sash from and against a window frame, the assembly comprising:

a motor mountable to the window sash, said motor having an output drive shaft;

an output arm having one portion pivotally connectable to the window sash and a second portion operably connectable to the window frame; and means for operably connecting said motor drive shaft to said output arm for controlling pivotal movement of said output arm in relation to said sash including a gear reducing train having first and second gears rotatable about a first axis, said first and second gears having large and small diameter portions, and third and fourth gears rotatable about a second axis parallel to said first axis, said third and fourth gears having large and small diameter portions, wherein the large diameter portion of the first gear is operably connected to the motor drive shaft, the small diameter portion of the first gear engages the large diameter portion of the third gear, the small diameter portion of the third gear engages the large diameter portion of the second gear, the small diameter portion of the second gear engages the large diameter portion of the fourth gear, and the small diameter portion of the fourth gear is operably connected to the output arm.

4. The assembly of claim 3, wherein all of the gears comprise evoloid gears.

5. An assembly for opening and closing a window sash from and against a window frame, the assembly comprising:

a motor mountable to the window sash, said motor having an output drive shaft;

an output arm having one portion pivotally connectable to the window sash and a second portion operably connectable to the window frame;

means for operably connecting said motor drive shaft to said output arm for controlling pivotal movement of said output arm in relation to said sash including a gear reducing train; and a housing disposable in a cavity defined in a generally rectangular box shape on a sash side, said motor, said operably connecting means, and said gear reducing train disposed in said housing.

6. The assembly of claim 5, wherein said housing has finger-jointed ends which engage matching finger-joints formed on opposite sides of the cavity.

7. The assembly of claim 6, wherein said housing is comprised of a thermally non-conductive material and is adhesively bondable within the sash cavity.

8. An assembly for opening and closing a window sash from and against a window frame, the assembly comprising:

a motor mountable to the window sash, said motor having an output drive shaft;

a gear reducing train operably connected to said motor drive shaft;

driving means comprising a worm operably connected to said gear reducing train and a worm gear engaging said worm;

an output arm having one portion pivotally connectable to the window sash and a second portion operably connectable to the window frame;

means for selectively operably connecting said worm gear to said output arm for controlling pivotal movement of said output arm in relation to the window sash, said connecting means including a first transmission element drivably connected to the support arm and a second transmission element drivably connected to the output drive shaft; and manually operable means for selectively moving one of said first and second transmission elements relative to the other between a first position wherein the first and second elements are fixed together against relative movement by a non-slip connection to drivably connect said drive shaft to said output arm, and a second position wherein the first and second elements are secured together for selected movement relative to each other to drivably disconnect said drive shaft from said output arm.

9. An assembly for opening and closing a window sash from and against a window frame, the assembly comprising:

a motor mountable to the window sash, said motor having an output drive shaft;

a gear reducing train operably connected to said motor drive shaft;

driving means comprising a worm operably connected to said gear reducing train and a worm gear engaging said worm;

an output arm having one portion pivotally connectable to the window sash and a second portion operably connectable to the window frame;

means for selectively operably connecting said worm gear to said output arm for controlling pivotal movement of said output arm in relation to the window sash;

manually operable means for selectively releasing the operably connecting means; and a housing disposable in a cavity defined in a generally rectangular box shape on a window sash side, said motor, said gear reducing train, said driving means, and said operably connecting means disposed in said housing.

10. The assembly of claim 9, wherein said housing has finger-jointed ends which engage matching finger-joints formed on opposite sides of the cavity.

11. The assembly of claim 10, wherein said housing is comprised of a thermally non-conductive material and is adhesively bondable within the sash cavity.

12. An assembly for opening and closing a window sash from and against a window frame, the assembly comprising:

a motor mountable to the window sash, said motor having an output drive shaft;

a gear reducing train operably connected to said motor drive shaft;

driving means comprising a worm operably connected to said gear reducing train and a worm gear engaging said worm;

an output arm having one portion pivotally connectable to the window sash and a second portion operably connectable to the window frame;

means for selectively operably connecting said worm gear to said output arm for controlling pivotal movement of said output arm in relation to the window sash comprising a spline shaft secured to said output arm and means for selectively connecting said spline shaft to said worm gear for rotation therewith, said means for selectively connecting said spline shaft to said worm gear including a cylindrical collar disposed around and having inner teeth meshing with said spline shaft, said cylindrical collar further having outer teeth meshing with inner teeth in a central opening of said worm gear when axially aligned therewith, and means for selectively moving said cylindrical collar axially along said spline shaft between a first position with its outer teeth aligned with said worm gear and a second position with its outer teeth spaced from said cylindrical collar, and manually operable means for selectively releasing the operably connecting means.

13. The assembly of claim 12, wherein said selectively moving means comprises:

axially spaced teeth on said cylindrical collar;

a control gear engaging said axially spaced teeth; and a manually operable actuator operably secured to said control gear.

14. The assembly of claim 13, wherein said manually operable actuator comprises a handle projecting from said sash.

15. The assembly of claim 13, wherein said manually operable actuator comprises:

an actuator gear engaging said control gear; and a handle operably secured to said actuator gear and projecting from said sash.

16. A window sash assembly comprising:

a window sash on one side having a substantially rectangular box shape with a selected thickness;

a generally box shaped cavity defined in said one sash side with finger-joints on the window sash at opposite ends of the cavity, said cavity having a depth substantially equal to the selected thickness of the one sash side; and a generally box shaped housing having two end walls connected by two side walls with a first closing wall connected to said end walls and said side walls, said walls defining an enclosure adapted to receive a window sash control system, wherein said end walls have matching finger-joints engaging said finger-joints on opposite ends of the cavity, and said side walls each have substantially planar outer surfaces, with said outer surfaces being substantially parallel and spaced apart a distance substantially equal to said selected thickness.

17. The mounting structure of claim 16, further comprising a second closing wall connected to said end walls and said side walls opposite said first closing wall.

18. The mounting structure of claim 16, wherein said housing walls are thermally non-conductive.

19. The mounting structure of claim 16, wherein said housing finger-joints are adhesively bonded to said sash finger-joints.

* * * * *